United States Patent [19]

Kern

[11] Patent Number: 4,745,946

[45] Date of Patent: May 24, 1988

[54] PIPE SEPARATOR

[76] Inventor: Johann H. Kern, Wimpasing 4, D-8221 Vachendorf, Fed. Rep. of Germany

[21] Appl. No.: 17,162

[22] PCT Filed: Jun. 5, 1986

[86] PCT No.: PCT/EP86/00336

§ 371 Date: Jan. 28, 1987

§ 102(e) Date: Jan. 28, 1987

[87] PCT Pub. No.: WO86/07400

PCT Pub. Date: Dec. 18, 1986

[30] Foreign Application Priority Data

Jun. 5, 1985 [DE] Fed. Rep. of Germany ..... 3520250

[51] Int. Cl.[4] ..... F16K 21/00

[52] U.S. Cl. ..... 137/614.2; 137/488

[58] Field of Search ..... 137/488, 485, 613, 614.2

[56] References Cited

FOREIGN PATENT DOCUMENTS 0182004 5/1986 European Pat. Off. .

2849825 5/1980 Fed. Rep. of Germany .

84/02544 7/1984 PCT Int'l Appl. .

*Primary Examiner*—Alan Cohan

*Attorney, Agent, or Firm*—Donald Brown; Robert T. Gammons

[57] ABSTRACT

A pipe separator (1) comprising a control valve (7) for actuating a sliding valve (4) is provided. In order to increase the service time of the sliding valve by avoiding an unnecessary switching frequency, a two positions-three directions directional valve acting as a damping element is additionally provided.

16 Claims, 4 Drawing Sheets

PIPE SEPARATOR

The invention refers to a pipe separator according to the preamble of claim 1.

A pipe separator of this kind is known from the DE-OS No. 32 47 325.

It is the object of the invention to provide a pipe separator of the above mentioned kind which is improved with regard to the known type. In particular it shall have less switching oscillations.

This object is achieved by a pipe separator of the above mentioned kind which is, according to the invention, characterized by the features of the characterizing part of claim 1.

Further features and advantages of the invention will stand out from the description of an embodiment in connection with the Figures. In the Figures.

Figure 1:
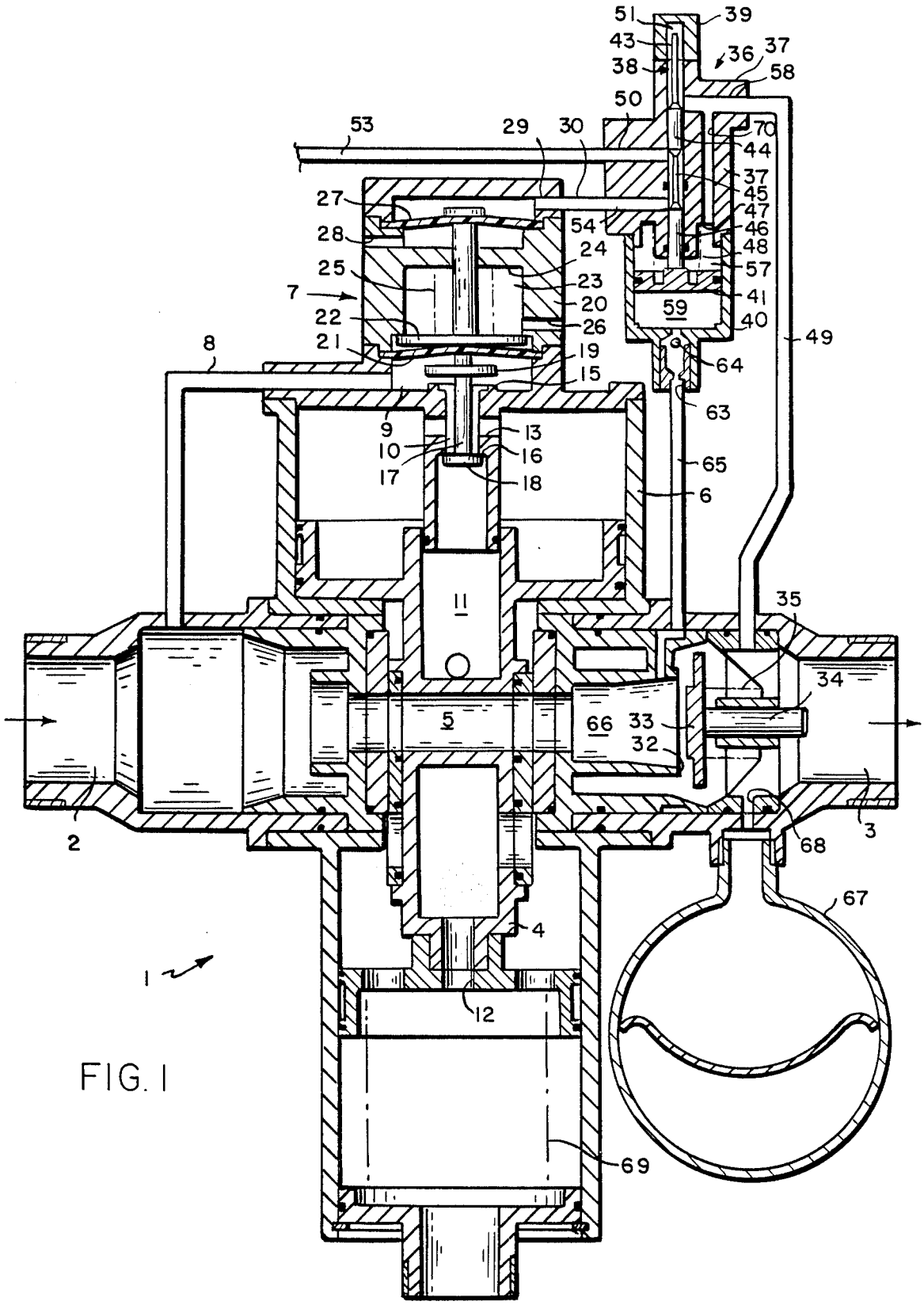
FIG. 1 is a sectional view through a pipe separator according to the invention in a first position.

The pipe or tube separator 1 comprises an inlet 2 adapted to be connected with a pipe and an outlet 3 adapted to be connected with a pipe. A sliding valve 4 having a connecting canal 5 is provided between the inlet 2 and the outlet 3. As may be seen from FIG. 1, the sliding valve connects the inlet 2 with the outlet 3 in the shown position thereof, whereas it disconnects the inlet and the outlet from each other in a not shown second position in which it is displaced in a direction transversely to the connecting canal. One end of the sliding valve 4 extends into a cylinder 6 wherein it may slide back and forth in the form of a piston in dependence on the pressure prevailing within the cylinder.

The interior of the cylinder 6 may be connected with the inlet 2 through a control valve 7 and a connecting conduit 8. The control valve 7 comprises a valve chamber with a first portion 9 and a second portion 10. The inlet of the first portion 9 is connected with the connecting conduit 8 forming the first inlet of the control valve and the outlet of the first portion is connected with the second portion 10. The second portion is formed as a bore having its end remote from the first portion opening into a bore 11 of the sliding valve 4. This bore 11 leads through an outlet bore 12 into the open air or a chamber, respectively, which is acted upon by the ambient pressure or at least a pressure which is less than the pressure prevailing at the inlet 2 in presence of a flow medium.

The second portion 10 is connected with the interior of the cylinder 6 through cross holes 13. It comprises valve seats 15, 16 at the end thereof facing the first portion as well as at the end thereof facing the bore 11. A valve stem 17 is provided passing through the second portion and having a valve body 18 at the end thereof remote from the first portion and a second valve body 19 in a distance from the first valve body, the distance being greater than the distance between the two valve seats 15, 16. As may be seen from FIG. 1, the surface area of the second valve body 19 facing the first portion is larger than the area of the first valve body 18 acted upon by the second portion.

The wall of the first portion 9 which is opposite to the second portion 10 is formed by a diaphragm 21 which has the edge thereof firmly clamped by means of a control valve housing 20. The valve stem 17 is extended through the first portion such that, passing through the diaphragm 21, it is rigidly connected with an abutment plate 22 and with the diaphragm 21 itself. On that side of the diaphragm which is turned away from the valve chamber, the control valve housing 20 forms a chamber 23 which is defined by an abutment 24 on the side remote from the diaphragm. A compression spring 25 biassing the diaphragm and thus the valve body into the second position through the abutment plate is disposed between the abutment 24 and the abutment plate 22. The chamber 23 is in connection with the open air through a bore 26 passing through the control valve housing. The abutment plate 22 is, but means of a connecting rod, firmly connected with a second pressure sensing device formed as a second diaphragm 27 which has the edges thereof rigidly clamped and which is disposed coaxially to the diaphragm 21. That side of the second diaphragm which faces the diaphragm 21 is in connection with the open air through a bore 28, whereas that side of the second diaphragm which is turned away from the diaphragm 21 is connected with a connecting conduit 30 through a bore forming the second inlet of the control valve.

A shut-off valve having a valve seat 32 disposed at the inlet side of the outlet 3 and a valve body 33 cooperating therewith is provided at the outlet side 3. The valve body 33 has a valve stem 34 at the rear side thereof, the valve stem being supported in a suitable mounting in a manner to be reciprocally slidable towards the valve seat and away therefrom. A compression spring 35 for biassing the valve body towards the valve seat is provided at a suitable abutment.

Moreover, a directional valve 36 with two positions and three directions is provided. This valve comprises a housing 37 with a cylinder bore 38 extending therethrough in the longitudinal direction thereof. A cap 39 made of a translucent material, which is screwed onto the housing, is provided at the one end of the cylinder bore. The cylinder bore 38 continues into this cap but does not pass therethrough, rather being closed by the cap in one direction. At the side of the housing which is opposite to the cap 39, there is provided a cylinder 40 having a piston 41 disposed therein such that it may reciprocate in axial direction of the bore within the cylinder. The piston is firmly connected with a control rod 42 extending into the cylinder bore 38 and guided thereby. The control rod 42, FIGS. 4 and 5, has a first section 43 at the end thereof facing the cap 39, the diameter of the first section being smaller than that of the cylinder bore. The first section is followed by a second section 44 having substantially the same diameter as the cylinder bore 38. The second section is followed by a third section 45 having a diameter which is again smaller than the diameter of the cylinder bore. The third section is followed by a fourth section 46 extending to the piston 41 and having a diameter whichis again substantially equal to that of the cylinder bore.

Figure 3:
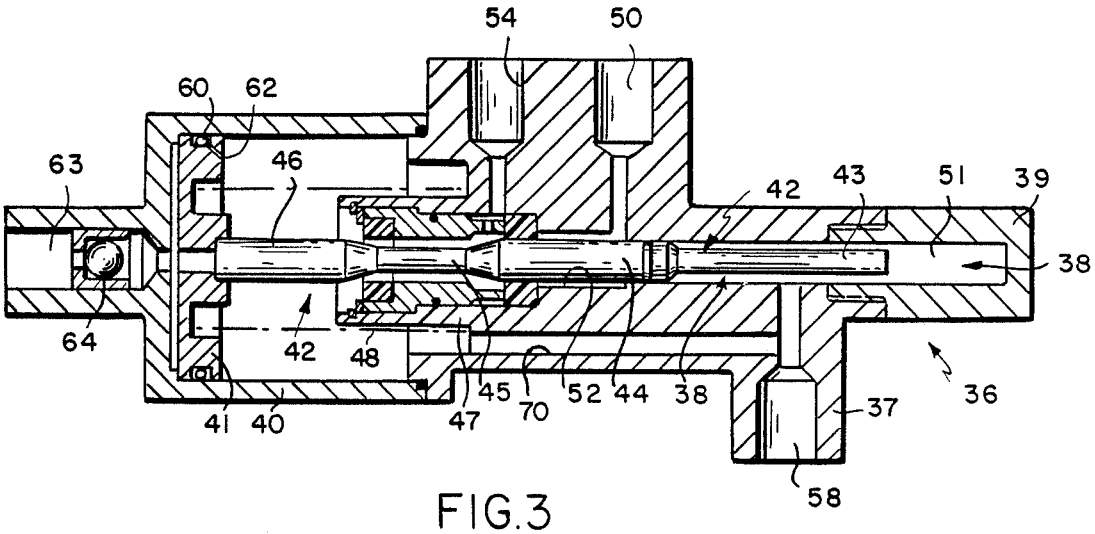
FIG. 3 is an enlarged representation of the valve used in the pipe separator shown in the FIGS. 1 and 2, the valve being in a first position.

A compression spring 48 is provided between an abutment face 47 of the housing and the pistion 41, the compression spring biassing the piston and thus the control rod firmly connected thereto into the position shown in FIG. 3 in which the piston is moved away from the housing down to the bottom of the cylinder 40. The piston 41 and thus the control rod 42 may be reciprocated between this first position and a second position shown in FIG. 4 in which the piston is moved in a direction contrary to the effect of the spring up to the housing and the control rod is moved up into the bore of the cap 39.

Figure 2:
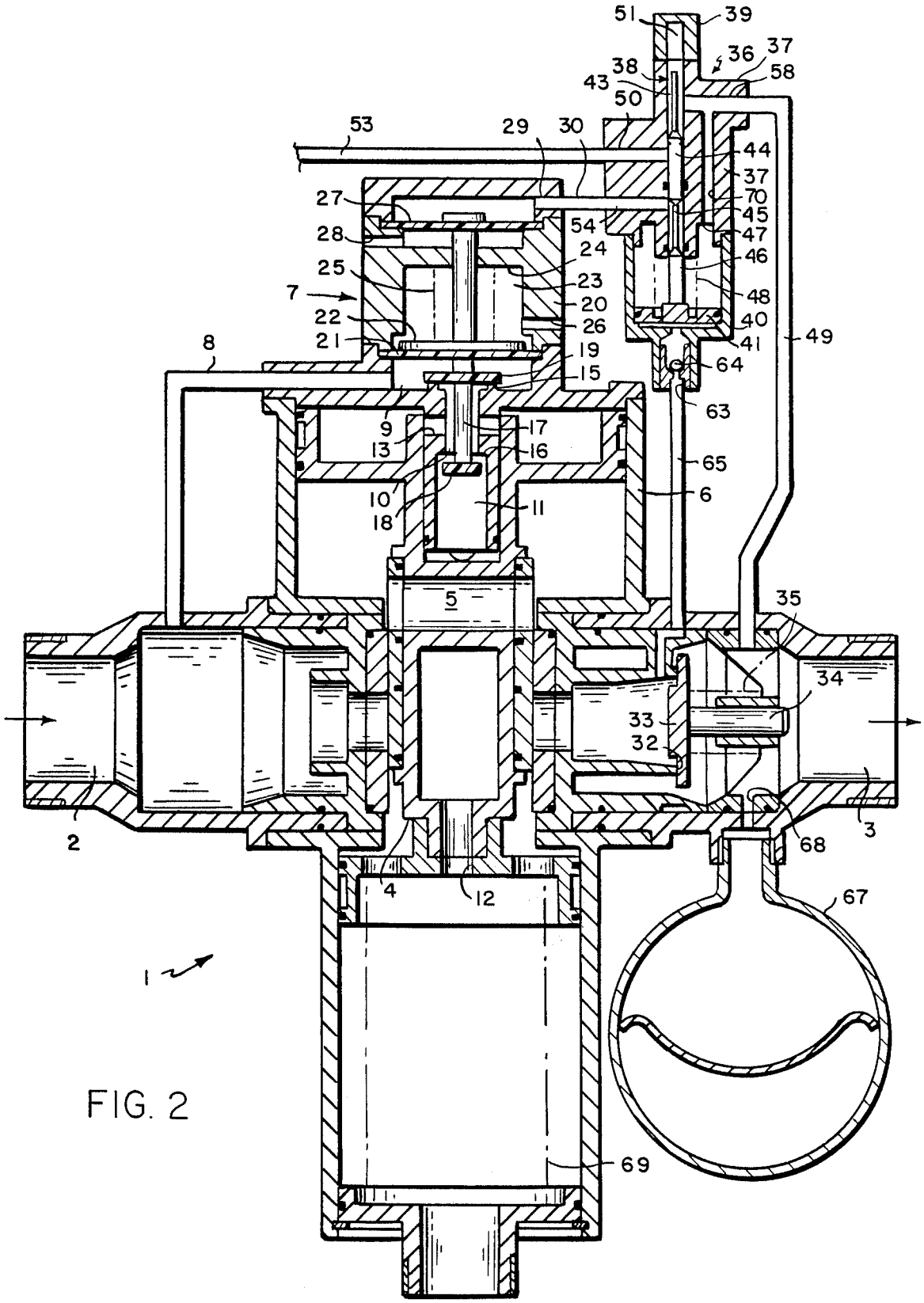
FIG. 2 shows the pipe separator of FIG. 1 in a second position.
Figure 4:
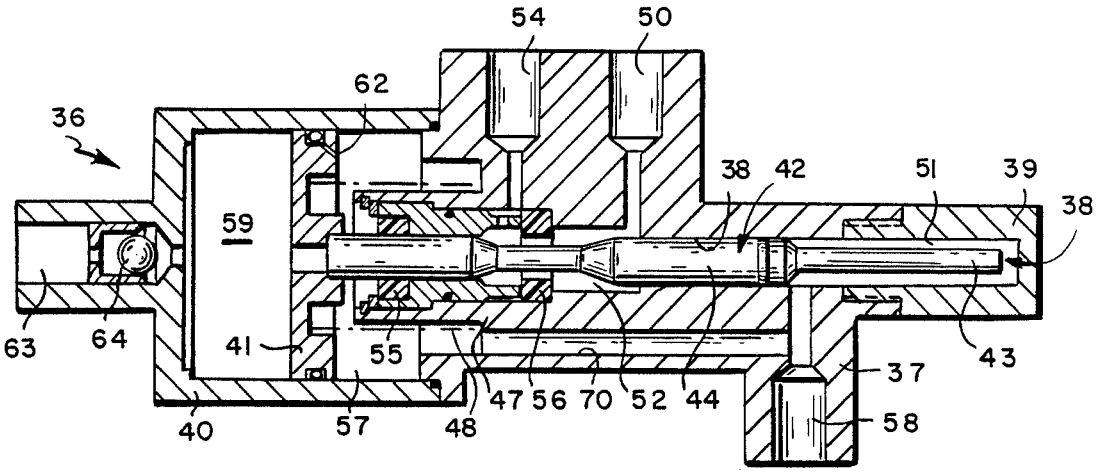
FIG. 4 shows the valve of FIG. 3 in a second position.
Figure 5:
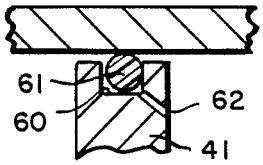
FIG. 5 is an enlarged representation of a part of the valve shown in FIG. 4.

As may be best seen from FIG. 4 a first cross-hole 58 is provided in the housing which leads into the cylinder bore 38 and which is arranged such that it opens, in the second position shown in FIG. 2, into that region in the cylinder bore 38 in which the first section 43 of the control rod is positioned. The first cross-hole 58 is connected with one end of a conduit 49 which has the other end thereof opening into the outlet 3 at the rear side of the valve body 33 facing the outlet, as may be best seen from FIG. 1.

The cylinder bore 38 comprises a first portion 51 having a diameter which is substantially equal to the diameter of the second section 44 of the control rod 42. This portion extends from the cap 39 close to that end of the second section 44 of the control rod which faces the piston 41. This first portion is followed, directed towards the piston, a second portion 52 having a diameter which is greater than the diameter of the second section 44 of the control rod. A second cross-hole 50 is provided which opens into the cylinder bore at the upper end of the second portion turned away from the piston 41 and which is connected through a conduit 53 with the open air or with the chamber which comprises the outlet of the outlet bore 12. Moreover a third cross-hole 54 is provided which, as is shown in particular in the FIGS. 3 and 4, opens into the cylinder bore at the lower end of the second portion thereof facing the piston rod and which is connected with the bore 29 of the control valve 7 and hence with the second diaphragm chamber thereof through a connecting conduit 30.

As may be best seen from the FIGS. 3 and 4, sealing rings 55 and 56 are provided in the cylinder bore 38 which are disposed in axial direction in such a manner that a seal is obtained in the position shown in FIG. 4 between the first chamber 57 lying between the piston and the housing and the cylinder bore and in the first position shown in FIG. 3 between the second cross-hole and the third cross-hole.

A connecting bore 70 is provided between the first chamber 57 and the first cross-hole 58. Furthermore, as may be best seen from FIG. 5 which represents the encircled part in FIG. 4 on an enlarged scale, a throttled port 62 is provided between the first chamber 57 and the second chamber 59 formed between the rear side of the piston 41 turned away from the housing and the bottom of the cylinder 40. The piston has an annnular groove 60, FIG. 5, on the outer circumference thereof, in which a loosely fitted annular seal 61 is provided which is biassed towards the cylinder wall. The throttling port 62 is provided between the annular groove 60 and the surface of the piston facing the first chamber 57.

Furthermore, a bore is provided at that side of the cylinder 40 which is turned away from the piston 41, the bore being adapted to be connected with an inlet 63 and having a check valve 64 disposed therein which allows the flow into the second chamber 59 and blocks a backflow from the second chamber into the inlet 63.

In the manner best shown in FIG. 1 the inlet 63 is connected through a conduit 65 with the region 66 which is adjacent to the sliding valve on the one side and is confined by the valve seat 32 on the other side and hence is closed towards the outlet when the valve body 33 rests on the valve seat.

Finally a diaphragm accumulator 67 is provided which is connected with the outlet 3 of the pipe separator through a bore 68 opening into the outlet chamber.

In operation the pipe separator is at first in the open position shown in FIG. 1. Liquid medium acts upon the inlet 2 and flows through the connecting canal 5, the valve 32, 33 and the outlet 3 to a consumer. The medium also flows through the conduit 8 into the valve chamber 9 and exerts a force in the direction of the first position, as shown in FIG. 1, of the control valve 7 on the diaphragm 21. Directed opposite to this force is that force which is exerted on the second diaphragm 27 by the compression spring 25 and the pressure of the medium acting through the connecting conduit 30. In case that the pressure prevailing in the first portion 9 exceeds that pressure which is exerted on the second diaphragm 27 by the medium supplied through the connecting conduit 30, by a certain amount which is predetermined by the surface areas of the diaphragms 21 and 27 and the amount of the biassing force of the compression spring 25, then the control valve 7 is in the first position shown in FIG. 1.

In this position the inlet pressure acts within the interior of the cylinder 6 through the cross-holes 13 and the connecting conduit 8. The bias of a compression spring 69 biassing the sliding valve 4 into the blocking position is selected such that, in this valve position, the sliding valve 4 is in the open position shown if the inlet pressure corresponds to the pressure prevailing at the inlet 2 in case that the full pressure of the flow medium is acting onto the inlet side.

In the above described embodiment the springs 25 and 35 are designed for 0.55 bar, whereas the spring 48 is designed for 0.3 bar.

If the pressure prevailing at the inlet 2 falls in relation to the pressure prevailing at the outlet 3 below a value given by the spring values, then first the valve body 33 moves into the closing position shown in FIG. 2. The check valve 64 closes at the same time. By effect of the spring 48 the piston 41 displaces the liquid within the second chamber 59 into the first chamber 57 through the throttling port 62, and the piston moves from the position shown in FIG. 4 into the position of FIG. 3. Thus the relatively higher pressure prevailing at the outlet reaches the region above the diaphragm 27. By that and by the simultaneous effect of the compression spring 25 the control valve is moved into its second position shown in FIG. 2, in which the first portion 9 of the valve chamber is separated from the second portion 10 by the valve body 19 and in which the interior of the cylinder 6 is connected with the bore 11 because the valve body 18 is lifted from the valve seat 16. By this pressure within the interior of the cylinder 21 decreases such that the compression spring 69 moves the sliding valve 4 into its second position shown in FIG. 2 in which the inlet is separated from the outlet.

If a very small amount drains away on the outlet side, e.g. by trickling of a tap, then the pipe separator remains in the blocking position shown in FIG. 2 and the small amount of water is withdrawn from the diaphragm accumulator 67 in a known manner.

Figure 6:
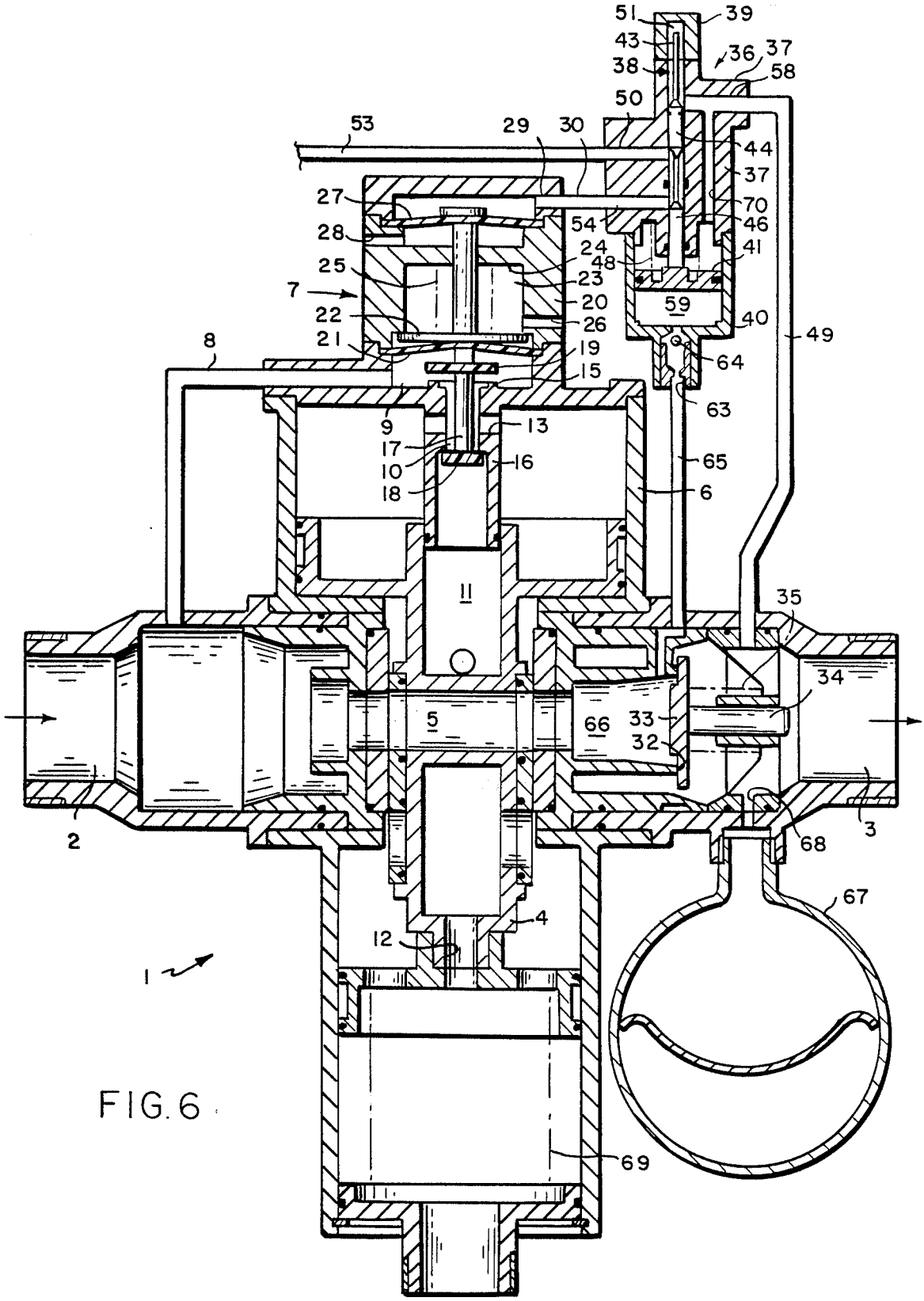
FIG. 6 shows a third switching position of the pipe separator.

If a small amount is withdrawn at the outlet side, then the third position shown in FIG. 6 is obtained. The sliding valve 4 and the check valve 64 are both in open position. The piston 41 has moved from the position shown in FIG. 3 into that of FIG. 4. This is achieved in that a greater bias acts upon the valve 32, 33 than the product of the piston 41 in combination with the spring 48. The pressure maintaining effect between conduit 65 and 49 is greater in case of the valve 32, 33 than between piston 41 and spring 48. A small amount of liquid may be withdrawn through the conduits 65 and 49. If the water flow is again reduced a bit, then first the check valve 64 is moved back into the closing position and thereafter the piston 41 starts a backward movement from the position shown in FIG. 4 into that of FIG. 3. If the water flow increases again before the piston has reached the lowermost position shown in FIG. 3, the piston returns upward without the sliding valve 44 having moved in the meantime into the separating position. Hence the valve 36 causes a damping and reduction of the switch frequency of the sliding valve 4.

I claim:

1. Pipe separator comprising blocking means being movable in response to pressure from an inlet of the pipe separator and to the action of biasing means and connecting in a first position the inlet with an outlet of the pipe separator and separating in a second position the inlet from the outlet; a control valve being a differential pressure valve or pressure comparing valve, in one state of operation the pressure prevailing at the inlet acting on a first side of the control valve and the pressure prevailing at the outlet acting on a second side of the control valve, the control valve comprising means response to the difference of the pressure acting on the first side and the pressure acting on the second side for switching the blocking means into a first and second position, respectively; a shutoff valve biased into a position blocking the flow from the inlet to the outlet; a valve opening in a first position a first connection between the ambient pressure and the second side of the control valve and connecting in the first position in case the shutoff valve is closed the inlet side of the shutoff valve with the outlet of the pipe separator and opening in a second position another connection between the outlet and the second side of the control valve via closing the first connection.

2. Pipe separator according to claim 1, characterized in that the valve is designed as a time-lag device.

3. Pipe separator according to claim 1 characterized in that the body of the valve comprises a passage between both opposite sides of the valve body, the passage having a throttling effect.

4. Pipe separator according to claim 2 further characterized in that a check valve is provided between the valve body and the associated inlet side.

5. Pipe separator according to claim 3 characterized in that a check valve is provided between the valve body and the associated inlet side.

6. Pipe separator according to claim 1 characterized in that the valve is designed as a two-position, three-direction directional valve.

7. Pipe separator according to claim 2 characterized in that the valve is designed as a two-position, three-direction directional valve.

8. Pipe separator according to claim 1 characterized by an optical display indicating the operational state of the valve.

9. Pipe separator according to claim 2 characterized by an optical display device indicating the operational state of the valve.

10. Pipe separator according to claim 3 characterized by an optical display device indicating the operational state of the valve.

11. Pipe separator comprising blocking means movable in response to pressure from an inlet of the pipe separator and to the action of biasing means and connecting in a first position the inlet with an outlet of the pipe separator and separating in a second position the inlet from the outlet; a control valve being a differential pressure valve or pressure comparing valve, in one state of operation the pressure prevailing at the inlet acting on a first side of the control valve and the pressure prevailing at the outlet acting on a second side of the control valve, the control valve comprising means responsive to the difference of the pressure acting on the first side and the pressure acting on the second side for switching the blocking means into a first and second position, respectively, a shutoff valve biased into a position blocking the flow from the inlet to the outlet; a valve being designed as a time-lag device and comprising a valve body having a passage between both opposite sides of the valve body, the passage having a throttling effect, the valve opening in a first position a first connection between the ambient pressure and the second side of the control valve and connecting in the first position in case that the shutoff valve is closed the inlet side of the shutoff valve with the outlet of the pipe separator and opening in a second position another connection between the outlet and the second side of the control valve via closing the first connection.

12. Pipe separator according to claim 11 characterized in that a check valve is provided between the valve body and the associated inlet side.

13. Pipe separator according to claim 11 characterized in that the valve is designed as a two-position, three-direction directional valve.

14. Pipe separator according to claim 12 characterized in that a check valve is provided between the valve body and the associated inlet side and that the valve is designed as a two-position, three-direction directional valve.

15. Pipe separator according to claim 11 characterized by an optical display indicating the operational state of the valve.

16. Pipe separator according to claim 12 characterized by an optical display indicating the operational state of the valve.

* * * * *